US012382995B2

(12) United States Patent
Chen

(10) Patent No.: US 12,382,995 B2
(45) Date of Patent: Aug. 12, 2025

(54) ELECTRONIC VAPORIZATION DEVICE

(71) Applicant: Shenzhen Verdewell Technology Limited, Guangdong (CN)

(72) Inventor: Long Chen, Shenzhen (CN)

(73) Assignee: Shenzhen Verdewell Technology Limited, Shenzhen (CN)

( * ) Notice: Subject to any disclaimer, the term of this patent is extended or adjusted under 35 U.S.C. 154(b) by 378 days.

(21) Appl. No.: 18/080,478

(22) Filed: Dec. 13, 2022

(65) Prior Publication Data

US 2023/0180837 A1 Jun. 15, 2023

(30) Foreign Application Priority Data

Dec. 15, 2021 (CN) ..... 202123156423.7

(51) Int. Cl.
*A24F 40/46* (2020.01)
*A24F 40/20* (2020.01)
*A24F 40/42* (2020.01)

(52) U.S. Cl.
CPC ..... *A24F 40/46* (2020.01); *A24F 40/20* (2020.01); *A24F 40/42* (2020.01)

(58) Field of Classification Search
None
See application file for complete search history.

(56) References Cited

U.S. PATENT DOCUMENTS 1,118,276 A 11/1914 Fredericks
11,147,128 B2 * 10/2021 Qiu ..... A24F 40/46
2013/0269716 A1 * 10/2013 Hoang ..... A24F 1/28 131/191
2015/0013696 A1 1/2015 Plojoue et al.
2015/0366267 A1 12/2015 Liu
2017/0303587 A1 * 10/2017 Johnson ..... A24F 40/46
2018/0055091 A1 3/2018 Trzecieski
2020/0008475 A1 * 1/2020 Lai ..... H05B 3/18
2020/0390986 A1 12/2020 Rosen
2022/0022541 A1 * 1/2022 Pijnenburg ..... H05B 1/0227
2023/0180838 A1 6/2023 Xie

FOREIGN PATENT DOCUMENTS

CN 106617324 A 5/2017
CN 208850681 U 5/2019

OTHER PUBLICATIONS

US 10,448,674 B1, 10/2019, Volodarsky et al. (withdrawn)

(Continued)

*Primary Examiner* — Philip Y Louie
*Assistant Examiner* — Morgan Faith Dezendorf
(74) *Attorney, Agent, or Firm* — Leydig, Voit & Mayer, Ltd.

(57) ABSTRACT

An electronic vaporization device includes: a nozzle integrated condensation cap; and a heating component accommodated in the nozzle integrated condensation cap, the heating component including a heating bowl, a vaporization cavity for accommodating an aerosol-forming substrate being formed in the heating bowl. An accommodating cavity for accommodating the heating component, and a cooling channel and an inhalation channel in communication with the vaporization cavity in sequence, are formed in the nozzle integrated condensation cap.

24 Claims, 5 Drawing Sheets

(56) References Cited

OTHER PUBLICATIONS

Learn Something New, "Push-type elastic self-locking mechanism, the principle is really ingenious," http://www.360doc9.net/wxarticlenew/961261849.html, Feb. 8, 2021.
Canadian Intellectual Property Office, First Office Action in Canadian Patent Application No. 3,184,957 (Apr. 24, 2024).
Canadian Intellectual Property Office, First Office Action in Canadian Patent Application No. 3,185,160 (Apr. 26, 2024).
Canadian Intellectual Property Office, Notice of Allowance in Canadian Patent Application No. 3,185, 160 (Jun. 2, 2025).
Canadian Intellectual Property Office, Notice of Allowance in Canadian Patent Application No. 3,184,957 (Jun. 3, 2025).
U.S. Patent and Trademark Office, Office Action in U.S. Appl. No. 18/080,507 (Jun. 2, 2025).
U.S. Patent and Trademark Office, Office Action in U.S. Appl. No. 18/080,507 (Mar. 21, 2025).

* cited by examiner

ELECTRONIC VAPORIZATION DEVICE

CROSS-REFERENCE TO PRIOR APPLICATION

Priority is claimed to Chinese Patent Application No. 202123156423.7, filed on Dec. 15, 2021, the entire disclosure of which is hereby incorporated by reference herein.

FIELD

The present invention relates to the field of vaporization, and in particular, to an electronic vaporization device.

BACKGROUND

During operation of an existing electronic vaporization device using a heating bowl for baking, an aerosol-forming substrate (for example, plant leaves, a tobacco paste, or a tobacco shred) filling the heating bowl is heated to generate smoke, and the smoke is condensed by a condensation cap and then outputted for inhalation by a user, so as to prevent smoke with an excessively high temperature from scalding the user. In order to communicate the heating bowl with the condensation cap, a structure of the existing electronic vaporization device is relatively complex, or occupies a relatively large space, which causes inconvenient use for a user, and impedes storage and carrying.

SUMMARY

In an embodiment, the present invention provides an electronic vaporization device, comprising: a nozzle integrated condensation cap; and a heating component accommodated in the nozzle integrated condensation cap, the heating component comprising a heating bowl, a vaporization cavity configured to accommodate an aerosol-forming substrate being formed in the heating bowl, wherein an accommodating cavity configured to accommodate the heating component, and a cooling channel and an inhalation channel in communication with the vaporization cavity in sequence, are formed in the nozzle integrated condensation cap.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
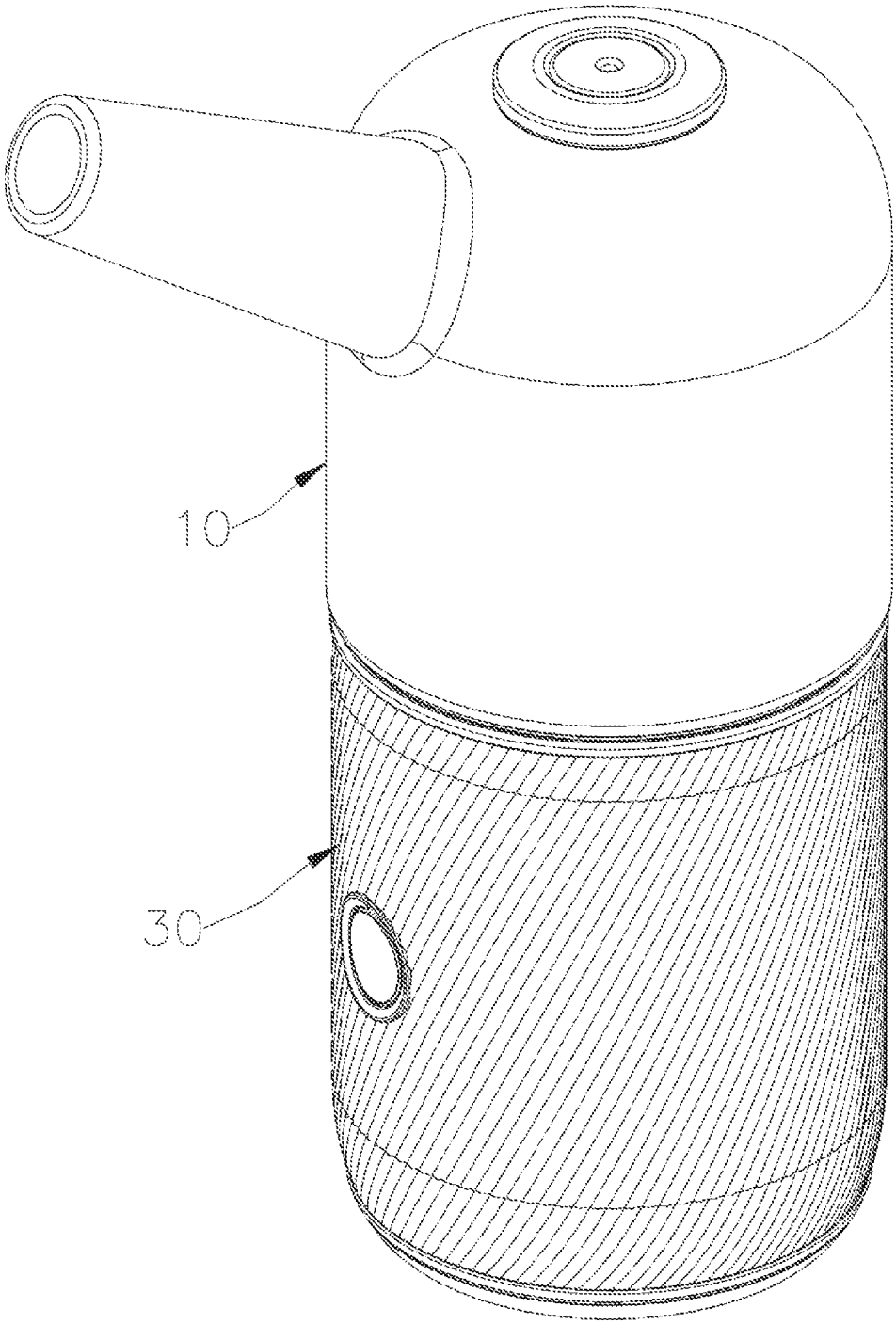
FIG. 1 is a schematic three-dimensional structure diagram of an electronic vaporization device according to some embodiments of the present invention.

In an embodiment, the present invention provides an improved electronic vaporization device for the foregoing defects in the prior art.

In an embodiment, the present invention provides an electronic vaporization device, including a nozzle integrated condensation cap and a heating component accommodated in the nozzle integrated condensation cap. The heating component includes a heating bowl, and a vaporization cavity configured to accommodate an aerosol-forming substrate is formed in the heating bowl. An accommodating cavity configured to accommodate the heating component and a cooling channel and an inhalation channel in communication with the vaporization cavity in sequence are formed in the nozzle integrated condensation cap.

In some embodiments, the cooling channel includes a first cooling channel in communication with the vaporization cavity and a second cooling channel in communication with the first cooling channel.

In some embodiments, the first cooling channel and the second cooling channel both extend along a longitudinal direction, and airflows in the first cooling channel and the second cooling channel are in opposite directions.

In some embodiments, the first cooling channel is arranged on a periphery of the accommodating cavity, and the second cooling channel is arranged on a periphery of the first cooling channel.

In some embodiments, the nozzle integrated condensation cap includes an outer cap, a first isolating wall, and a second isolating wall.

The first isolating wall is arranged in the outer cap along a longitudinal direction, and an inner wall surface of the first isolating wall defines the accommodating cavity.

The second isolating wall is arranged in the outer cap along a longitudinal direction and is located between the outer cap and the first isolating wall. The first cooling channel is defined between an outer wall surface of the first isolating wall and an inner wall surface of the second isolating wall, and the second cooling channel is defined between an outer wall surface of the second isolating wall and an inner wall surface of the outer cap.

In some embodiments, at least one first air outlet configured to communicate the accommodating cavity with the first cooling channel is arranged on the first isolating wall, and at least one second air outlet configured to communicate the first cooling channel with the second cooling channel is arranged on the second isolating wall. The at least one first air outlet and the at least one second air outlet are respectively located at an upper end and a lower end of the first cooling channel.

In some embodiments, the inhalation channel is in communication with an upper end of the second cooling channel.

In some embodiments, the inhalation channel has an inhalation end away from the second cooling channel and a connection end close to the second cooling channel, and the inhalation end of the inhalation channel is at a higher position than the connection end.

In some embodiments, a pore size of the inhalation channel gradually decreases from the connection end to the inhalation end.

In some embodiments, condense water is provided in the cooling channel.

In some embodiments, the nozzle integrated condensation cap is made of glass.

In some embodiments, a limiting flange that extends inward is formed on an inner wall surface of an upper end of the accommodating cavity, and an upper end of the heating bowl abuts against the limiting flange.

In some embodiments, a through hole in communication with the accommodating cavity is arranged on the limiting flange.

In some embodiments, at least one vent opening configured to communicate the vaporization cavity with the cooling channel is formed on a side wall of the heating bowl.

In some embodiments, the vent opening extends downward from a top surface of the side wall of the heating bowl.

In some embodiments, the heating bowl is made of a ceramic material.

In some embodiments, the heating component further includes a heating body, and the heating bowl is accommodated in the heating body.

In some embodiments, a heating cavity configured to accommodate the heating bowl is formed in the heating body, and an upper end of the heating bowl extends out of the heating cavity.

In some embodiments, a plurality of thermal insulation protrusions that protrude are formed on a cavity wall of the heating cavity, and an outer wall surface of the heating bowl abuts against the plurality of thermal insulation protrusions.

In some embodiments, the heating body includes at least one electrode pole, and an upper end of the at least one electrode pole abuts against a bottom surface of the heating bowl.

Implementing the present invention brings at least the following beneficial effects: The electronic vaporization device has a simple structure, is convenient to assemble, and is easy to receive and carry.

To provide a clearer understanding of the technical features, objectives, and effects of the present invention, specific implementations of the present invention are described with reference to the accompanying drawings. In the following description, many specific details are provided to facilitate a full understanding of the present invention. However, the present invention may alternatively be implemented in other manners different from those described herein, and a person skilled in the art may make similar modifications without departing from the content of the present invention. Therefore, the present invention is not limited to the embodiments disclosed below.

In the description of the present invention, it should be understood that directions or location relationships indicated by terms "center", "longitudinal", "transversely", "length", "width", "thickness", "upper", "lower", "front", "rear", "left", "right", "vertical", "horizontal", "top", "bottom", "inner", "outer", "clockwise", "counterclockwise" "axial direction", "radial direction" and "circumferential direction" are based on the directions or location relationships shown in the accompanying drawings or the directions or location relationships that are usually placed when the product of the present invention is used, and are merely used for the convenience of describing the present invention and simplifying the description, but are not used to indicate or imply that a device or an element needs to have a particular direction or be constructed and operated in a particular direction, and therefore, cannot be understood as a limitation to the present invention.

In addition, terms "first" and "second" are used merely for the purpose of description, and shall not be construed as indicating or implying relative importance or implying a quantity of indicated technical features. Therefore, features defining "first" and "second" can explicitly or implicitly include at least one of the features. In description of the present invention, "multiple" means at least two, such as two and three unless it is specifically defined otherwise.

In the present invention, unless otherwise explicitly specified or defined, the terms such as "mount", "connect", "connection", and "fix" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two elements or mutual action relationship between two elements, unless otherwise specified explicitly. A person of ordinary skill in the art can understand specific meanings of the terms in the present invention according to specific situations.

In the present invention, unless explicitly specified or limited otherwise, a first characteristic "on" or "under" a second characteristic may be the first characteristic in direct contact with the second characteristic, or the first characteristic in indirect contact with the second characteristic by using an intermediate medium. In addition, that the first feature is "above", "over", or "on" the second feature may indicate that the first feature is directly above or obliquely above the second feature, or may merely indicate that the horizontal position of the first feature is higher than that of the second feature. That the first feature is "below", "under", and "beneath" the second feature may be that the first feature is right below the second feature or at an inclined bottom of the second feature, or may merely indicate that the horizontal position of the first feature is lower than that of the second feature.

It should be noted that, when a component is referred to as "being fixed to" or "being arranged on" another component, the component may be directly on the another component, or there may be an intermediate component. When one component is considered as "being connected to" another component, the component may be directly connected to the another component, or an intermediate component may simultaneously exist. The terms "vertical", "horizontal", "upper", "lower", "left", "right", and similar expressions used in this specification are merely used for an illustrative purpose, and do not represent the only implementation.

Figure 2:
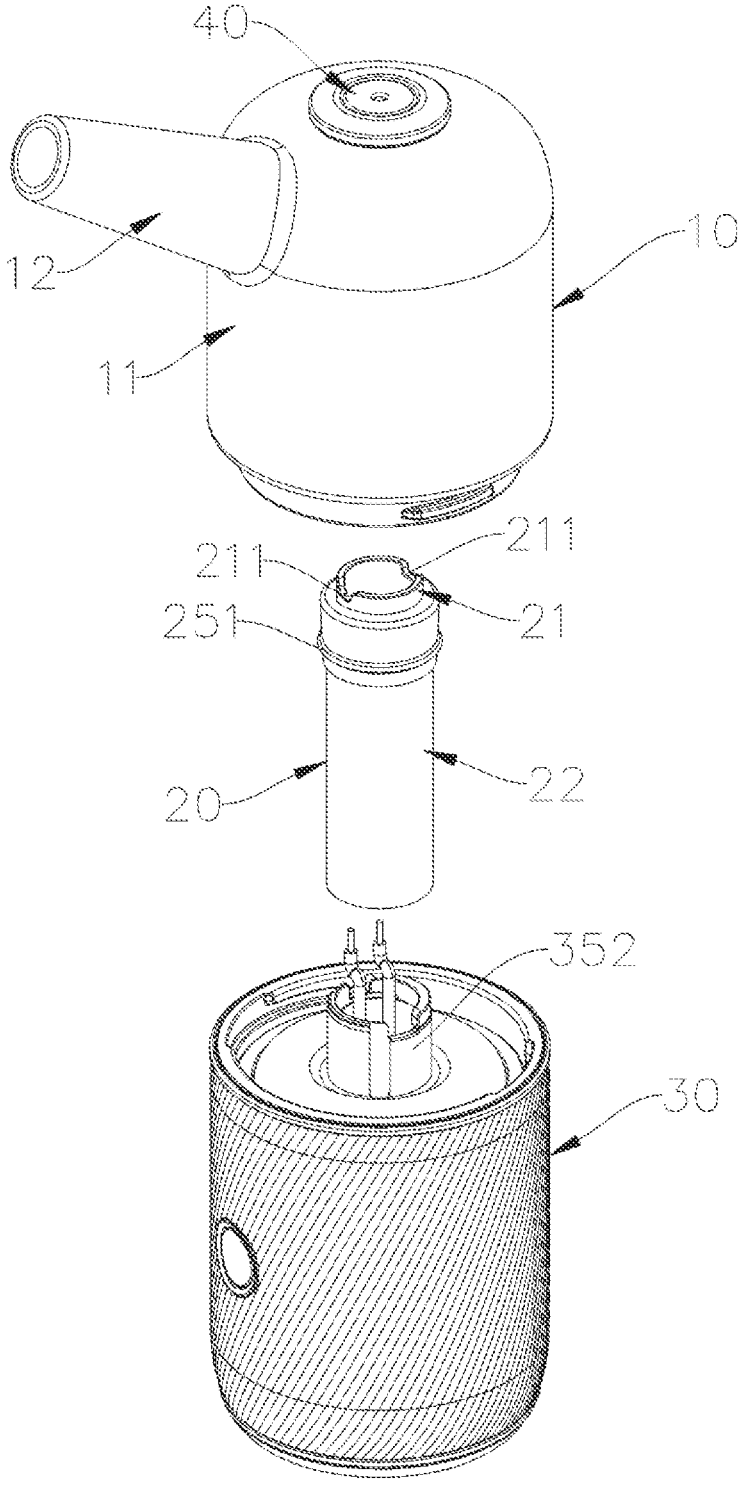
FIG. 2 is a schematic structural exploded view of the electronic vaporization device shown in FIG. 1.
Figure 3:
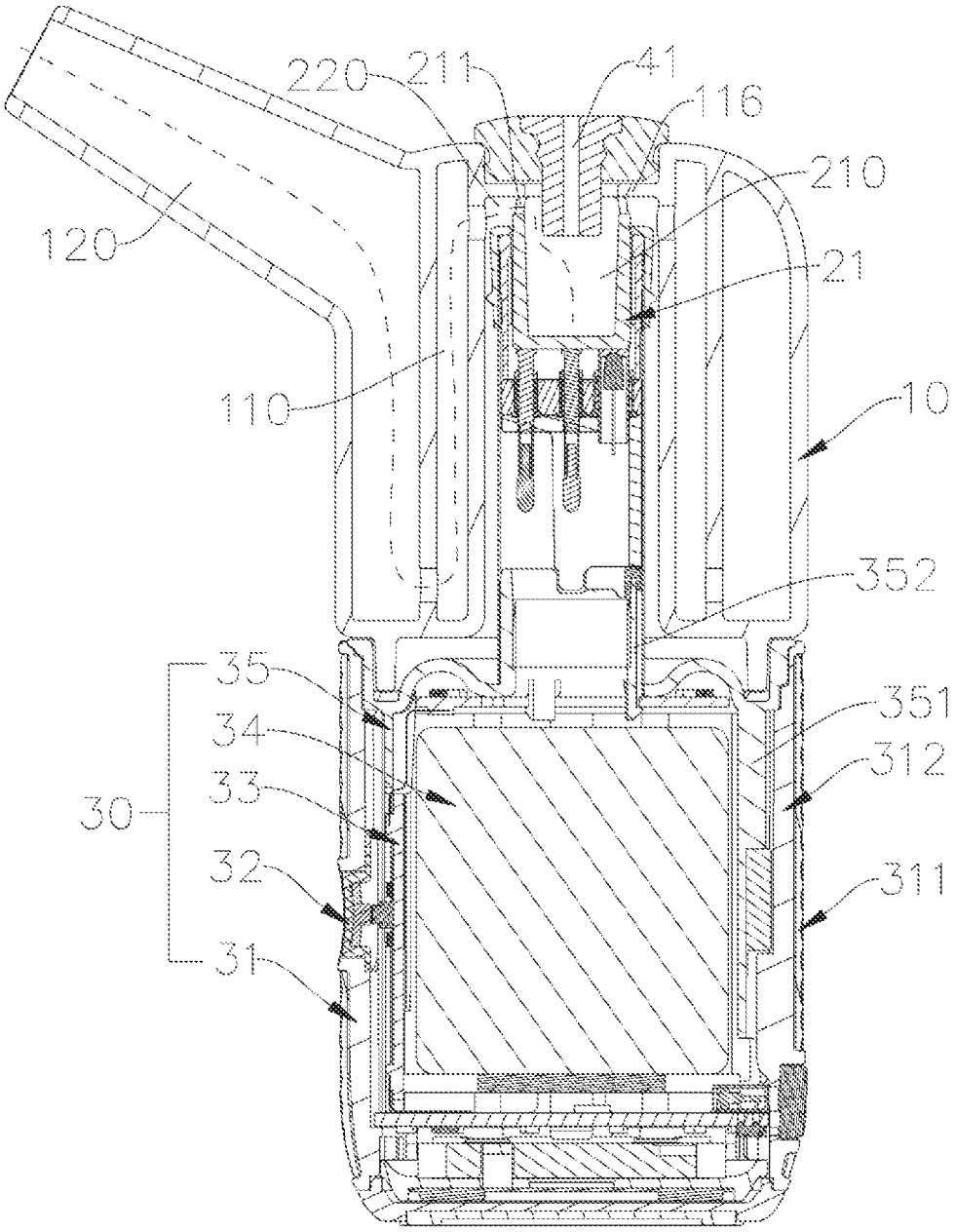
FIG. 3 is a schematic structural cross-sectional view of the electronic vaporization device in FIG. 1.

FIG. 1 to FIG. 3 show an electronic vaporization device according to some embodiments of the present invention. The electronic vaporization device may be substantially in a shape of a round column, and may include a main unit 30, a nozzle integrated condensation cap 10 arranged above the main unit 30 along a longitudinal direction, and a heating component 20 arranged in the nozzle integrated condensation cap 10. The main unit 30 is configured to supply power to the heating component 20, and may control turn-on and turn-off of the entire electronic vaporization device. A vaporization cavity 210 configured to accommodate and heat an aerosol-forming substrate is formed in the heating component 20. The aerosol-forming substrate may be in a form of a plant leave, a paste, or a gel. A cooling channel 110 and an inhalation channel 120 in communication with the vaporization cavity 210 in sequence are formed in the nozzle integrated condensation cap 10. An aerosol generated after the aerosol-forming substrate is heated and vaporized is cooled through the cooling channel 110 and then outputted through the inhalation channel 120 for inhalation by a user. It may be understood that, in other embodiments, the shape of the electronic vaporization device is not limited to the shape of a round column, but may also be other shapes such as the shape of an elliptical column, the shape of a square column, or the shape of a flat column.

In some embodiments, the main unit 30 may include a shell 31, a button 32, a circuit board 33, a battery 34, and a holder 35. The circuit board 33, the battery 34, and the holder 35 are all accommodated in the shell 31. A related control circuit is arranged on the circuit board 33. The control circuit is electrically connected to the battery 34 and the heating component 20 for controlling the battery 34 to supply power to the heating component 20. The button 32 is arranged on a side wall of the shell 31 and is configured to receive an operation performed by a user, so as to turn on the circuit board 33 to control the battery 34 to supply power to the heating component 20.

The shell 31 may be cylindrical, and may include a cylindrical first shell 311 located outside and a second cylindrical shell 312 located inside. The second shell 312 may be a hard shell, which provides support and protection. The first shell 311 is sleeved outside the second shell 312. The first shell 311 may be made of a soft material such as a soft glue, which can improve a touch feeling for a user.

In some embodiments, the holder 35 may include a holder body 351 accommodated in the shell 31 and a sleeve portion 352 extending upward from a top wall of the holder body 351. The holder body 351 may be in a shape of a cylinder having an opening on a side. The battery 34 may be accommodated in the holder body 351, and the circuit board 33 may be arranged on the side of the holder body 351 having the opening and arranged corresponding to the button 32. The sleeve portion 352 may be cylindrical, and may be formed by integrally extending upward on the top wall of the holder body 351. The sleeve portion 352 may extend out of the shell 31 and is configured to be sleeved on and connected to the heating component 2.

The nozzle integrated condensation cap 10 is arranged above the main unit 30 along the longitudinal direction and may be detachably connected to the main unit 30 by screwing, magnetic connection, engagement, or the like. In some embodiments, the nozzle integrated condensation cap 10 may be made of glass or the like, and may include a cap body 11 and a nozzle 12 connected to the cap body 11. The inhalation channel 120 is formed in the nozzle 12, and the cooling channel 110 is formed in the cap body 11. Condense water may be further provided in the cooling channel 110. An aerosol passes through the condense water to be condensed and to filter out an impurity in the aerosol for inhalation by the user.

Figure 4:
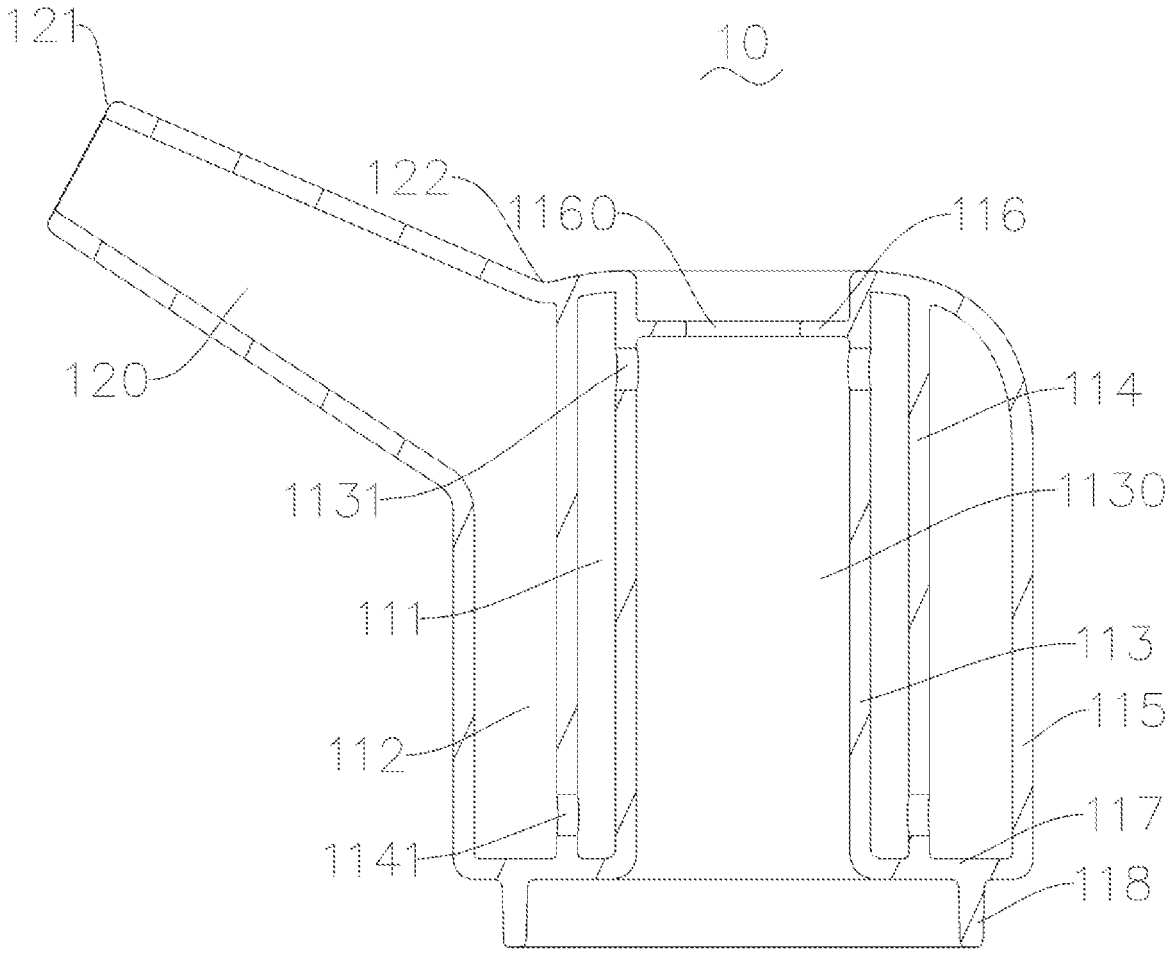
FIG. 4 is a schematic structural cross-sectional view of a nozzle integrated condensation cap in FIG. 2.

As shown in FIG. 3 and FIG. 4, in some embodiments, the cap body 11 may include an outer cap 115 and a first isolating wall 113 and a second isolating wall 114 arranged in the outer cap 115. The outer cap 115 may be substantially cylindrical, and an outer diameter of the outer cap 115 may be the same as an outer diameter of the shell 31. The outer cap 115 has an annular bottom wall 117. The bottom wall 117 may cover a lower end of the cooling channel 110. An annular connection portion 118 that integrally extends downward may be further formed on the bottom wall 117. An outer wall surface of the connection portion 118 may be provided with external threads, and an inner wall surface of the holder body 351 or an inner wall surface of the shell 31 is correspondingly provided with internal threads, so that the cap body 11 and the main unit 30 are screwed together.

The first isolating wall 113 may be formed by integrally extending downward on an inner side of a top wall of the outer cap 115. The first isolating wall 113 may be annular and may be arranged coaxially with the outer cap 115. An inner wall surface of the first isolating wall 113 defines an accommodating cavity 1130 configured to accommodate the heating component 20, and a lower end of the accommodating cavity 1130 is open to facilitate insertion of the heating component 20. A limiting flange 116 that extends inward along a transverse direction may be formed on an inner wall surface of an upper end of the first isolating wall 113. The limiting flange 116 may be configured to limit a position of the heating bowl 21 in the accommodating cavity 1130 along a longitudinal direction. In some embodiments, a through hole 1160 configured to communicate the accommodating cavity 110 with the outside may be further arranged on the limiting flange 116. The electronic vaporization device may further include a seal plug 40. The seal plug 40 may be arranged on a top of the outer cap 115 and abut against the limiting flange 116. A vent hole 41 may be formed on the seal plug 40 along a longitudinal direction. The vent hole 41 may be coaxially arranged with the accommodating cavity 110 and is configured to communicate the accommodating cavity 110 with the outside.

The second isolating wall 114 may be formed by integrally extending downward on the inner side of a top wall of the outer cap 115. The second isolating wall 114 may be annular and may be arranged coaxially with the outer cap 115. The second isolating wall 114 is located between the outer cap 115 and the first isolating wall 113, and is spaced apart from the outer cap 115 and from the first isolating wall 113. A first cooling channel 111 is defined between an inner wall surface of the second isolating wall 114 and an outer wall surface of the first isolating wall 113, and a second cooling channel 112 is defined between an outer wall surface of the second isolating wall 114 and an inner wall surface of the outer cap 115. That is to say, the accommodating cavity 110, the first cooling channel 111, and the second cooling channel 112 all extend along the longitudinal direction. The first cooling channel 111 is annular and is arranged on a periphery of the accommodating cavity 110, and the second cooling channel 112 is annular and is arranged on a periphery of the first cooling channel 111. Since the first cooling channel 111 and the second cooling channel 112 are annular, a relatively large accommodating space is available for accommodating a condensate.

At least one first air outlet 1131 configured to communicate the accommodating cavity 110 with the first cooling channel 111 is arranged on the first isolating wall 113, and at least one second air outlet 1141 configured to communicate the first cooling channel 111 with the second cooling channel 112 is arranged on the second isolating wall 114. The first air outlet 1131, the first cooling channel 111, the second air outlet 1141, and the second cooling channel 112 are in communication in sequence and form the cooling channel 110. In this embodiment, two first air outlets 1131 are symmetrically arranged on two sides of the first isolating wall 113 in a circumferential direction. Two second air outlets 1141 are symmetrically arranged on two sides of the second isolating wall 114 in a circumferential direction. The two second air outlets 1141 may be respectively arranged corresponding to the two first air outlets 1131. That is to say, a line connecting the two second air outlets 1141 may be parallel to a line connecting the two first air outlets 1131. It may be understood that, in other embodiments, one or more first air outlets 1131 and one or more second air outlet 1141 may be arranged. In other embodiments, an included angle may be formed between the line connecting the two second air outlets 1141 and the line connecting the two first air outlets 1131. For example, the included angle is 90 degrees.

Preferably, flowing directions of a vapor in the first cooling channel 111 and the second cooling channel 112 are opposite. The first air outlet 1131 is arranged on a side wall of the upper end of the first isolating wall 113, and may be located below the limiting flange 116 and close to the limiting flange 116. The second air outlet 1141 may be arranged on a side wall of the lower end of the second isolating wall 114 and close to the bottom wall 117. The upper end of the second cooling channel 112 is in communication with the inhalation channel 120, so that the cooling channel 110 is relatively long, thereby realizing more effective condensation and filtering. As shown by dashed lines in FIG. 3, the vapor generated in the vaporization cavity 210 enters an upper end of the first cooling channel 111 through the first air outlet 1131, and flows downward in the first cooling channel 111 to the second air outlet 1141 at the lower end, and then enters the second cooling channel 112 through the second air outlet 1141 and flows upward in the second cooling channel 112, and is finally outputted through the inhalation channel 120.

The nozzle 12 may be tubular. An inner wall surface thereof defines the inhalation channel 120. The nozzle 12 may be arranged on a side of the outer cap 115 corresponding to one of the second air outlets 1141, and may be formed by integrally extending on an outer wall surface of the outer cap 115. The nozzle 12 has an inhalation end 121 away from the outer cap 115 and a connection end 122 connected to the outer cap 115. The nozzle 12 may be arranged obliquely upward, so that the inhalation end 121 is at a higher position than the connection end 122, which facilitates inhalation by the user. An outer diameter and an inner diameter of the nozzle 12 may gradually decrease from the connection end 122 toward the inhalation end 121, so that a pore size of the inhalation channel 120 gradually decreases from the connection end 122 toward the inhalation end 121. In this way, the vapor at the inhalation end 121 is more concentrated, and inhalation experience is more desirable. In addition, the outer diameter of the nozzle 12 at the inhalation end 121 is relatively small, which helps the user hold the nozzle in the mouth.

Figure 5:
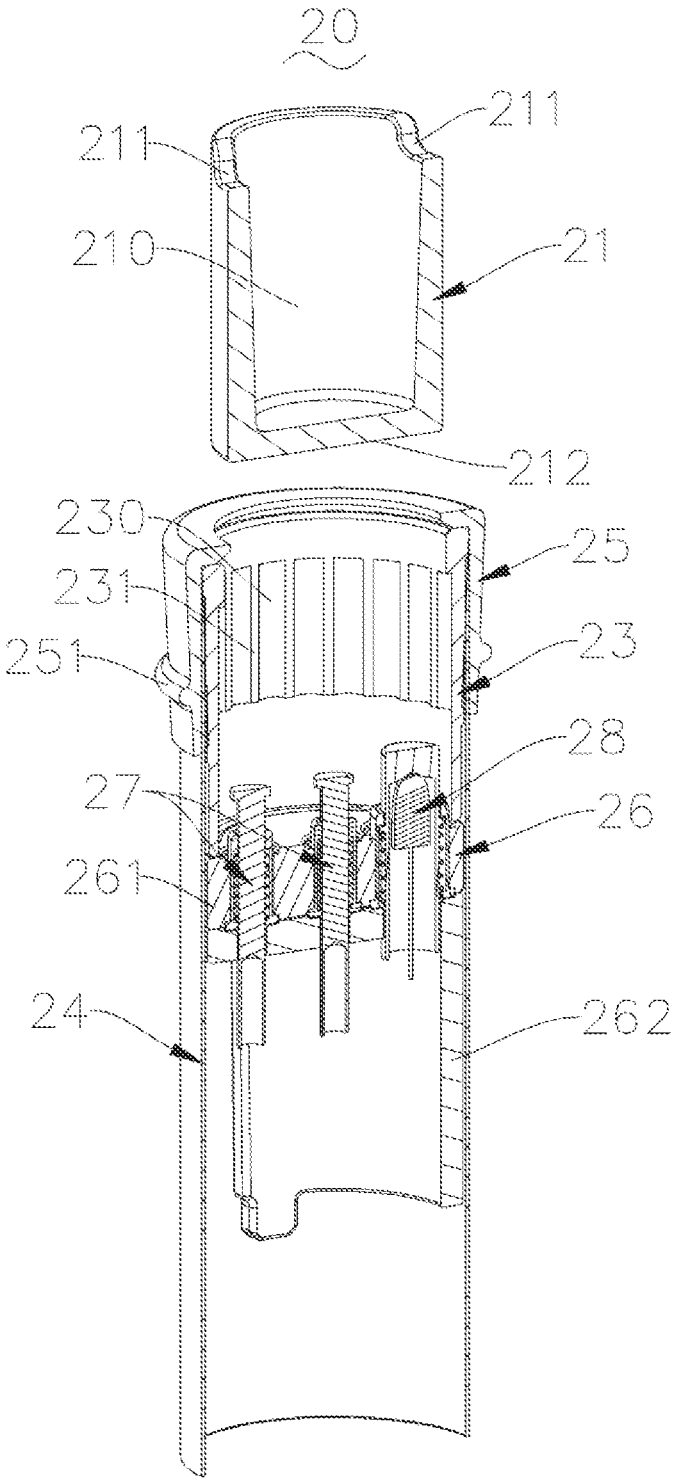
FIG. 5 is a schematic structural cross-sectional exploded view of a heating component in FIG. 2.

As shown in FIG. 3 and FIG. 5, the heating component 20 may be cylindrical, may be accommodated in the accommodating cavity 110, and includes a heating body 22, a heating bowl 21 accommodated in the heating body 22, and a heating element arranged in the heating bowl 21.

The heating bowl 21 may be cylindrical, and an inner wall surface of the heating bowl 21 defines the vaporization cavity 210 configured to accommodate the aerosol-forming substrate. The heating bowl 21 may be made of a ceramic material, for example, an environmentally friendly ceramic material such as alumina, aluminum nitride, or silicon nitride, which is harmless to a human body when heated at a high temperature. The heating bowl 21 has a heating surface 212. The heating element may be arranged on the heating surface 212. The heating element is configured to heat and vaporize the aerosol-forming substrate after being electrified, so as to generate an aerosol for inhalation by the user. Specifically, in this embodiment, the heating surface 212 configured to arrange the heating element is formed on a bottom surface of the heating bowl 21. The heating element may be a heating film and may be formed on the heating surface 212 by screen printing or the like. It may be understood that, in other embodiments, the heating element is not limited to the heating film. For example, the heating element may alternatively be a metal heating sheet.

An upper end of the heating bowl 21 may extend out of the heating body 22 and abut against the limiting flange 116. At least one vent opening 211 configured to communicate the vaporization cavity 210 with the first air outlet 1131 may be further formed on a side wall of the heating bowl 21. In this embodiment, two vent openings 211 are symmetrically arranged on two sides of the heating bowl 21 in a circumferential direction. Each of the vent openings 211 may be formed by extending downward on a top surface of the side wall of the heating bowl 21. The two vent openings 211 may be respectively arranged corresponding to the two first air outlets 1131. That is to say, a line connecting the two second vent openings 211 may be parallel to the line connecting the two first air outlets 1131. It may be understood that, in other embodiments, an included angle may be formed between the line connecting the two vent openings 211 and the line connecting the two first air outlets 1131. For example, the included angle is 90 degrees.

A vent gap 220 is formed between an upper end surface of the heating body 22 and a lower end surface of the limiting flange 116 to communicate the vent opening 211 with the first air outlet 1131. In some embodiments, the heating body 22 may include a heating tube 23, a fixed tube 24, a seal sleeve 25, a base component 26, at least one electrode pole 27, and at least one temperature detection element 28.

The heating tube 23 is sleeved outside the heating bowl 21. A lower end surface of the heating tube 23 may abut against an upper end surface of the base component 26. The heating tube 23 may be tubular. An inner wall surface of the heating tube 23 defines a heating cavity 230 configured to accommodate the heating bowl 21. A plurality of thermal insulation protrusions 231 that protrude inward along a radial direction may be formed on a cavity wall of the heating cavity 230. Each thermal insulation protrusion 231 may extend along an axial direction of the heating cavity 230. The plurality of thermal insulation protrusions 231 may be evenly distributed at intervals along a circumferential direction of the heating cavity 230. An outer wall surface of the heating bowl 21 may abut against the plurality of thermal insulation protrusions 231, which can greatly reduce a direct contact area between the heating bowl 21 and the heating tube 23, thereby facilitating thermal insulation.

An upper end of the fixed tube 24 is sleeved outside the heating tube 23, and a lower end of the fixed tube 24 may be sleeved on the sleeve portion 352 of the main unit 30. The seal sleeve 25 is sleeved outside the upper end of the fixed tube 24, and may be made of an elastic material such as silica gel. An annular flange 251 that extends outward along a radial direction may be formed on an outer wall surface of the seal sleeve 25. The annular flange 251 abuts against a cavity wall of the accommodating cavity 110 and is hermetically engaged with the cavity wall of the accommodating cavity 110, so that air leakage can be prevented.

The base component 26 is arranged in the fixed tube 24, and may be made of a ceramic material, such as zirconia ceramic. In some embodiments, the base component 26 may include a base body 261 and an extension 262 extending downward from an outer side of a bottom of the base body 261. A lower end of the extension 262 may abut against the sleeve portion 352.

The at least one electrode pole 27 and the at least one temperature detection element 28 may be sleeved on the base body 261 along a longitudinal direction. In this embodiment, two electrode poles 27 are arranged. The two electrode poles 27 are respectively electrically connected to two electrodes of the heating element. The electrode pole 27 may be an elastic electrode pole. An upper end of the electrode pole 27 may abut against the bottom surface of the heating bowl 21 to support the heating bowl 21, and is in contact with and connected to the heating element. One temperature detection element 28 may be arranged, which may be a temperature-sensing elastic pin. An upper end of the temperature detection element 28 may abut against the bottom surface of the heating bowl 21 to support the heating bowl 21.

During assembly of the electronic vaporization device, the heating component 20 may be inserted into the sleeve portion 352 of the main unit 30 first, and then the nozzle integrated condensation cap 10 may be screwed to the main unit 30. The electronic vaporization device has a simple structure and is convenient to assemble, which ensures portability and beauty of the electronic vaporization device while realizing functions.

It can be understood that the foregoing technical features can be used in any combination without limitation.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. An electronic vaporization device, comprising:

a nozzle integrated condensation cap comprisinq:

an outer cap and a seal plug, wherein the seal plug is positioned on the top of the outer cap and the nozzle is formed adjacent to the seal plug and on a side of the outer cap; and a heating component accommodated in the nozzle integrated condensation cap, the heating component comprising a heating bowl, a vaporization cavity being formed in the heating bowl, the vaporization cavity being configured to accommodate an aerosol-forming substrate, wherein an accommodating cavity is formed in the nozzle integrated condensation cap, the accommodating cavity being configured to accommodate the heating component, wherein a cooling channel and an inhalation channel are formed in the nozzle integrated condensation cap, the cooling channel and the inhalation channel collectively being in communication with the vaporization cavity in sequence, and wherein a limiting flange formed on an inner wall surface of an upper end of the accommodating cavity extends inward in a transverse direction of the electronic vaporization device.

2. The electronic vaporization device of claim 1, wherein the cooling channel comprises a first cooling channel in communication with the vaporization cavity and a second cooling channel in communication with the first cooling channel.

3. The electronic vaporization device of claim 2, wherein the first cooling channel and the second cooling channel both extend along a longitudinal direction, and wherein airflows in the first cooling channel and the second cooling channel are in opposite directions.

4. The electronic vaporization device of claim 2, wherein the first cooling channel is arranged on a periphery of the accommodating cavity, and wherein the second cooling channel is arranged on a periphery of the first cooling channel.

5. The electronic vaporization device of claim 2, wherein the nozzle integrated condensation cap comprises a first isolating wall, and a second isolating wall, wherein the first isolating wall is arranged in the outer cap along a longitudinal direction, and an inner wall surface of the first isolating wall defines the accommodating cavity, wherein the second isolating wall is arranged in the outer cap along a longitudinal direction and is located between the outer cap and the first isolating wall, wherein the first cooling channel is defined between an outer wall surface of the first isolating wall and an inner wall surface of the second isolating wall, and wherein the second cooling channel is defined between an outer wall surface of the second isolating wall and an inner wall surface of the outer cap.

6. The electronic vaporization device of claim 5, wherein at least one first air outlet configured to communicate the accommodating cavity with the first cooling channel is arranged on the first isolating wall, wherein at least one second air outlet configured to communicate the first cooling channel with the second cooling channel is arranged on the second isolating wall, and wherein the at least one first air outlet and the at least one second air outlet are respectively located at an upper end and a lower end of the first cooling channel.

7. The electronic vaporization device of claim 2, wherein the inhalation channel is in communication with an upper end of the second cooling channel.

8. The electronic vaporization device of claim 7, wherein the inhalation channel has an inhalation end away from the second cooling channel and a connection end close to the second cooling channel, and wherein the inhalation end of the inhalation channel is at a higher position than the connection end.

9. The electronic vaporization device of claim 8, wherein a pore size of the inhalation channel gradually decreases from the connection end to the inhalation end.

10. The electronic vaporization device of claim 1, wherein condensed water is provided in the cooling channel.

11. The electronic vaporization device of claim 1, wherein the nozzle integrated condensation cap comprises glass.

12. The electronic vaporization device of claim 1, wherein an upper end of the heating bowl abuts against the limiting flange.

13. The electronic vaporization device of claim 12, wherein a through hole in communication with the accommodating cavity is arranged on the limiting flange.

14. The electronic vaporization device of claim 1, wherein at least one vent opening configured to communicate the vaporization cavity with the cooling channel is formed on a side wall of the heating bowl.

15. The electronic vaporization device of claim 14, wherein the vent opening extends downward from a top surface of the side wall of the heating bowl.

16. The electronic vaporization device of claim 1, wherein the heating bowl comprises a ceramic material.

17. The electronic vaporization device of claim 1, wherein the heating component further comprises a heating body, and wherein the heating bowl is accommodated in the heating body.

18. The electronic vaporization device of claim 17, wherein a heating cavity configured to accommodate the heating bowl is formed in the heating body, and wherein an upper end of the heating bowl extends out of the heating cavity.

19. The electronic vaporization device of claim 18, wherein a plurality of thermal insulation protrusions that protrude are formed on a cavity wall of the heating cavity, and wherein an outer wall surface of the heating bowl abuts against the plurality of thermal insulation protrusions.

20. The electronic vaporization device of claim 17, wherein the heating body comprises at least one electrode pole, and wherein an upper end of the at least one electrode pole abuts against a bottom surface of the heating bowl.

21. An electronic vaporization device, comprising:

a nozzle integrated condensation cap; and a heating component accommodated in the nozzle integrated condensation cap, the heating component comprising a heating bowl, a vaporization cavity being formed in the heating bowl, the vaporization cavity being configured to accommodate an aerosol-forming substrate, wherein an accommodating cavity is formed in the nozzle integrated condensation cap, the accommodating cavity being configured to accommodate the heating component, wherein a cooling channel and an inhalation channel are formed in the nozzle integrated condensation cap, the cooling channel and the inhalation channel collectively being in communication with the vaporization cavity in sequence, wherein the cooling channel comprises a first cooling channel in communication with the vaporization cavity and a second cooling channel in communication with the first cooling channel, wherein the nozzle integrated condensation cap comprises an outer cap, a first isolating wall, and a second isolating wall, wherein the first isolating wall is arranged in the outer cap along a longitudinal direction, and an inner wall surface of the first isolating wall defines the accommodating cavity, wherein the second isolating wall is arranged in the outer cap along a longitudinal direction and is located between the outer cap and the first isolating wall, wherein the first cooling channel is defined between an outer wall surface of the first isolating wall and an inner wall surface of the second isolating wall, and wherein the second cooling channel is defined between an outer wall surface of the second isolating wall and an inner wall surface of the outer cap.

22. The electronic vaporization device of claim 21, wherein at least one first air outlet configured to communicate the accommodating cavity with the first cooling channel is arranged on the first isolating wall, wherein at least one second air outlet configured to communicate the first cooling channel with the second cooling channel is arranged on the second isolating wall, and wherein the at least one first air outlet and the at least one second air outlet are respectively located at an upper end and a lower end of the first cooling channel.

23. An electronic vaporization device, comprising:

a nozzle integrated condensation cap; and a heating component accommodated in the nozzle integrated condensation cap, the heating component comprising a heating bowl, a vaporization cavity being formed in the heating bowl, the vaporization cavity being configured to accommodate an aerosol-forming substrate, wherein an accommodating cavity is formed in the nozzle integrated condensation cap, the accommodating cavity being configured to accommodate the heating component, wherein a cooling channel and an inhalation channel are formed in the nozzle integrated condensation cap, the cooling channel and the inhalation channel collectively being in communication with the vaporization cavity in sequence, and wherein at least one vent opening configured to communicate the vaporization cavity with the cooling channel is formed on a side wall of the heating bowl.

24. The electronic vaporization device of claim 23, wherein the vent opening extends downward from a top surface of the side wall of the heating bowl.

* * * * *